United States Patent [19]

Rankin

[11] 4,428,421

[45] Jan. 31, 1984

[54] WIRELINE WINCH MOUNTING SYSTEM

[75] Inventor: E. Edward Rankin, Fort Worth, Tex.

[73] Assignee: H-G Testing Company, Ventura, Calif.

[21] Appl. No.: 301,772

[22] Filed: Sep. 14, 1981

[51] Int. Cl.[3] ..... E21B 19/00; E21B 33/03

[52] U.S. Cl. ..... 166/77; 166/84; 166/385; 166/50; 175/214; 254/134.3 FT

[58] Field of Search ..... 166/385, 77, 82–84, 166/250–255; 175/214, 50; 254/134.3 R, 134.3 FT

[56] References Cited

U.S. PATENT DOCUMENTS

| | | | |
|---|---|---|---|
| Re. 24,086 | 11/1955 | Summers . | |
| 2,255,648 | 9/1941 | Bryan . | |
| 2,370,818 | 3/1945 | Silverman | 175/50 |
| 2,555,145 | 5/1951 | McKinney | 166/77 |
| 2,567,009 | 9/1951 | Calhoun et al. . | |
| 2,569,390 | 9/1951 | Sewell | 175/50 |
| 2,630,180 | 3/1953 | Summers . | |
| 3,291,449 | 12/1966 | Hughes | 254/134.3 FT |
| 3,791,445 | 2/1974 | True . | |
| 3,866,679 | 2/1975 | Laky . | |
| 3,920,076 | 11/1975 | Laky . | |
| 3,981,364 | 9/1976 | Warner et al. . | |
| 4,083,401 | 4/1978 | Rankin | 166/250 |
| 4,090,573 | 5/1978 | Rankin | 175/214 X |

*Primary Examiner*—Ernest R. Purser
*Assistant Examiner*—Thuy M. Bui
*Attorney, Agent, or Firm*—James E. Bradley

[57] ABSTRACT

A wireline apparatus and method has features that prevent the wireline from moving with respect to the drill string due to drill string movement or wave action on the drill rig. The apparatus includes a frame having a wireline pressure sealing device. The pressure sealing device is mounted to the top of the drill string. A drum is rotatably mounted to the frame on the side of the pressure sealing device. The drum is powered by a hydraulic motor and controlled by a remote unit. Wireline is wrapped around the drum and reeved over a sheave which is mounted to the frame near the top of the wireline sealing device. A lift sub is secured to the top of the frame and enables the frame to be lifted by the rig elevators. The frame provides a linkage between the elevators and the drill string to lift the drill string.

7 Claims, 2 Drawing Figures

WIRELINE WINCH MOUNTING SYSTEM

BACKGROUND OF THE INVENTION

This invention relates in general to wireline operations in oil and gas wells, and in particular to a system for mounting the winch of a wireline.

There are two main types of wireline operations, slick line and conductor cable. In slick line operations, wireline tools are lowered into a well and manipulated to perform various functions, without the use of electrical current. In conductor cable operations, electrical current is passed to an instrument or tool downhole. The downhole tool may perform various operations, as well as provide surface indications of downhole well characteristics.

Both of these types use a power driven drum or winch wrapped with the wireline and located in a unit on the drill rig, or in the case of land rigs, normally a truck off to the side of the drill rig. The wireline is reeved through a lower sheave, which is tied to the rig or well head, then over an upper sheave, which may be supported by the well head equipment or by the rig, and down into the well conduit, which may be tubing, casing or drill pipe. Often, stringing the wireline through the sheaves places the wireline in an inconvenient position for other work going on the rig, particularly offshore rigs and platforms.

A more serious problem occurs when the drill pipe must be supported by travelling blocks when the wireline operation is being performed through the drill pipe. If it is necessary to move the drill pipe up or down while the downhole wireline tool remains stationary, line must be fed in or out simultaneously to avoid changing the tension in the line, or the line must be clamped at the top of the well.

The prior art wireline system of rigging up is also a problem in the case of offshore drilling rigs that float. In these types of rigs, the drill pipe or well conduit is substantially isolated from wave action. When not supported by the derrick, the well conduit will be supported by the subsea well head control equipment. While the drill pipe is being supported by the blocks, a heave compensator secured to the top of the blocks acts as a shock absorber to remove most of the wave action, so that the drill pipe will not move up and down with the drilling rig.

In a wireline operation on a floating rig, the upper sheave can be generally isolated from wave action by connecting it to the top of the drill pipe. The power driven drum, however, will be located on the rig and thus subject to wave action.

SUMMARY OF THE INVENTION

In this invention, a means is provided for supporting the rotatably driven drum on top of the well conduit. The drum thus will move in unison with the well conduit, or remain stationary with the well conduit, despite any movement by the rig. This also avoids having to string wirelines from a remote unit. In the preferred embodiment, a frame is secured to a tubular member which has a wireline sealing means contained within it. The tubular member is secured to the top of the well conduit. The drum is mounted to the frame and powered by energy means such as a hydraulic motor. A lift sub is mounted to the top of the frame for engagement by the elevators. The elevators will lift the wireline assembly, which in turn lifts the drill pipe. The drum is controlled by a unit located on the rig.

DESCRIPTION OF THE PREFERRED EMBODIMENT

Figure 1:
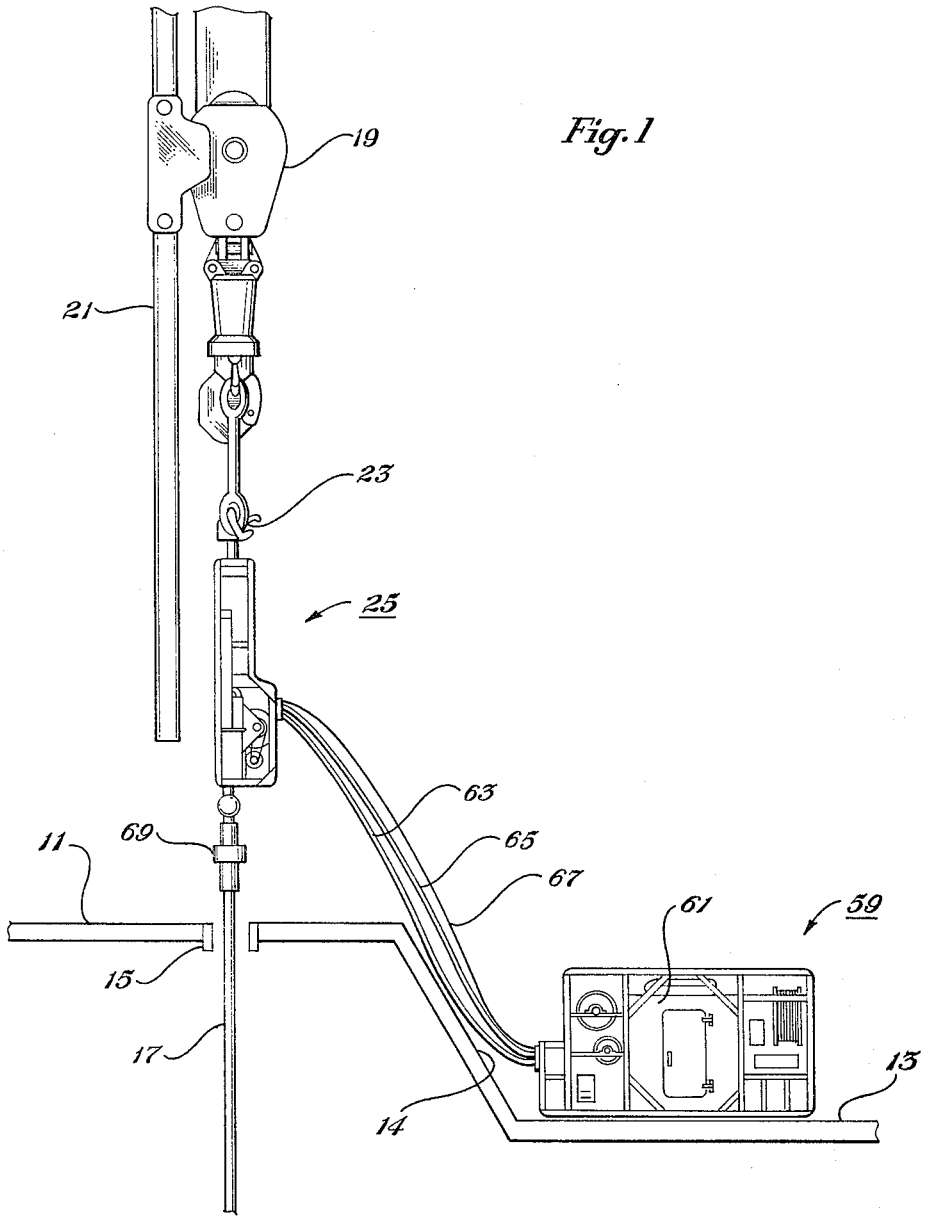
FIG. 1 is a schematic view of a wireline assembly constructed in accordance with this invention and rigged up.

Referring to FIG. 1, the numeral 11 represents a rig floor of an offshore drilling rig. Rig floor 11 is located above and connected to the supporting surface or catwalk 13 of the rig, the surface 13 and rig floor 11 being connected by an inclined section or "V" door ramp 14. Rig floor 11 has a rotary table 15 through which drill pipe 17 extends into the well. Subsea equipment (not shown) includes a blowout preventer to support drill string 17 when actuated and seal the drill pipe to the well annulus. A subsea test tree (not shown) connected into drill string 17 above the blowout preventer is actuable from rig floor 11 for sealing the inner passage of drill string 17.

A set of travelling blocks 19 are moved up and down block guide 21 by a drawworks (not shown). Blocks 19 have a wave or heave compensator means (not shown) for preventing blocks 19 from moving up and down due to wave action. Blocks 19 also have a set of elevators 23, which are releasable clamps for clamping around drill pipe to support the drill pipe. A wireline assembly 25 is connected to the top of the drill string 17 and supported by elevators 23.

Figure 2:
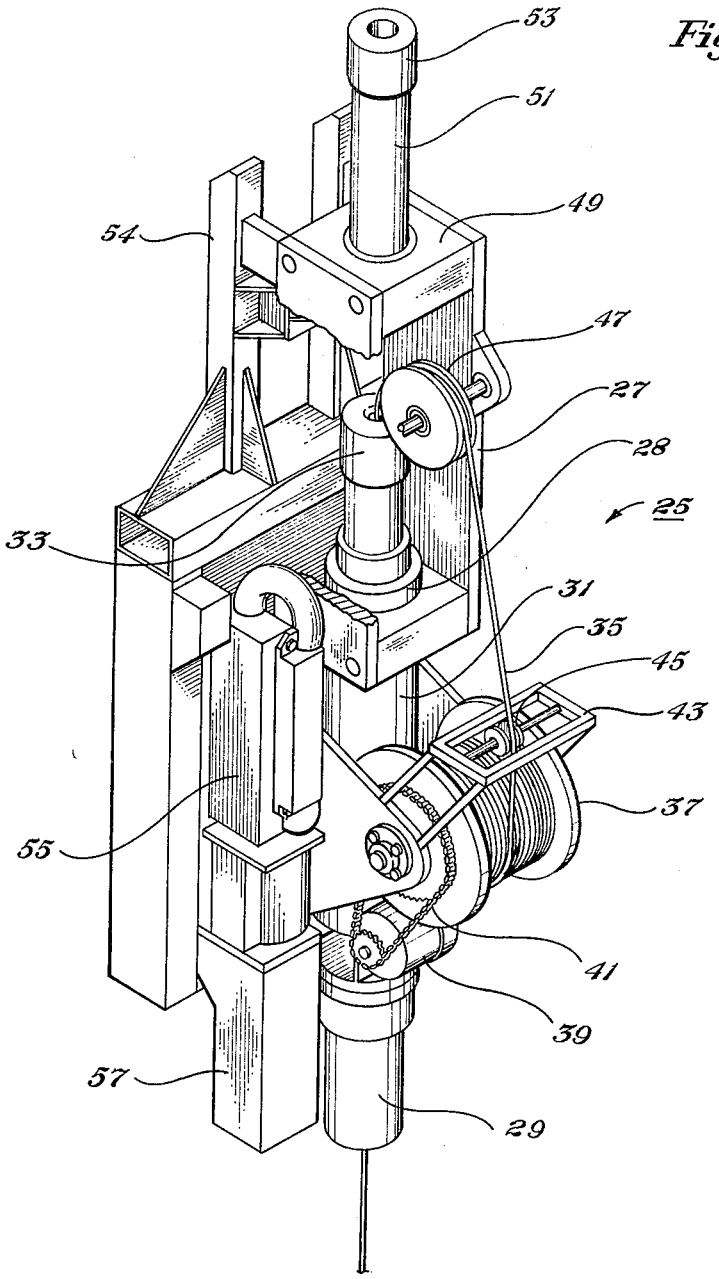
FIG. 2 is an enlarged partial perspective view of the wireline assembly of FIG. 1.

Referring to FIG. 2, wireline assembly 25 includes a frame 27. A tubular member 28 is mounted to the frame. Tubular member 28 comprises a quick connection 29 for securing to the top of drill string 17, a wireline sealing means 31 mounted to the top of the quick connection 29, and a hydraulic pack-off 33 mounted to the top of the wireline sealing means 31. The quick connection 29 is a threaded union of a conventional nature, to serve as mounting means for threadingly and sealingly engaging the top of drill string 17 without the need for rotating frame 27. When coupled to drill string 17, tubular member 28 will carry frame 27.

Wireline sealing means 31 is of a conventional type for sealing against the wireline while the wireline is static and also while moving. Close fitting tubes (not shown) are located within wireline sealing means 31. A viscous fluid such as grease is injected at high pressure through the tubes and around the wireline 35 to provide sealing. This type of wireline sealing means, also known as a "grease injector", is shown in U.S. Pat. No. 4,090,573 issued May 23, 1978, E. Edward Rankin, all of which material is hereby incorporated by reference.

Hydraulic pack-off 33 is a type of sealing device against wireline 35 that provides a tight seal while the wireline is static, but will not seal while moving. Generally, this type of device has split semi-cylindrical rams, each having a longitudinal groove through them for defining a passage for the wireline 35. The groove is contained within a resilient portion of the rams. Hydraulic pressure forces the rams into tight contact with the wireline 35 to provide sealing.

Wireline 35 is wound around a drum 37, which is rotatably mounted to frame 27 on one side of grease injector 31. Drum 37 is rotatably driven by a hydraulic motor 39 mounted to frame 27 and connected to drum 37 by a linkage such as a chain 41. A hydraulic brake (not shown) will selectively prevent rotation of drum 37. A wireline guide 43 is mounted to frame 27 above drum 37. Guide 43 has a roller 45 that traverses back and forth to wind the wireline 35 onto drum 37. A sheave 47 is rotatably mounted to frame 27 at a point slightly above and to one side of the pack-off 33. Sheave 47 guides the wireline 27 into the passage extending through pack-off 33, grease injector 31 and quick coupling 29. Frame 27 and tubular member 28 serve as drum support means for supporting the drum on top of the well conduit 17.

Frame 27 has an upper support 49 that extends over the top of pack-off 33. A cylindrical lift sub 51 is mounted to support 49 for lifting the assembly 25. Lift sub 51 is removable for transport. Lift sub 51 has an annular collar 53 at its top, which serves as means for engaging the upper edges of the elevators 23 (FIG. 1) for lifting the assembly 25. Lift sub 51 is tubular, with an axis that is aligned with the common axis of pack-off 33, grease injector 31 and quick coupling 29. Frame 27, tubular member 28, and lift sub 51 are rigidly coupled together and have the ability to support the weight of a drill string.

A pair of longitudinal skids 54 are mounted to the side of frame 27 opposite drum 37. Skids 54 extend the length of frame 27 and provide means for sliding assembly up inclined surface 14 (FIG. 1). Castors (not shown) facilitate movement. Assembly 25 also includes an air pump 55 which has an intake in a tank 57 that contains grease. Pump 55 is supplied with air pressure from an air compressor (not shown) for pumping grease from a reservoir 57 at high pressure into the grease injector 31.

Referring to FIG. 1, remote unit 59 is used to control wireline assembly 25 and is preferably located on an area other than rig floor 11, such as catwalk 13. Remote unit 59 has a cab 61 for housing operators of the wireline assembly 25. Remote unit 59 includes a diesel engine for driving a hydraulic pump (not shown) for providing pressurized hydraulic fluid through hose 63 to hydraulic motor 39 (FIG. 2). Other hydraulic hoses (not shown) provide pressurized fluid to the pack-off 33 and brakes. An air compressor (not shown) provides air pressure through a hose 65 to the grease injector air pump 55 (FIG. 2). In the preferred embodiment, wireline 35 (FIG. 2) is of a type that has an insulated conductor surrounded by a twisted wire layer for strength, the total diameter being about $\frac{1}{8}$ inch. A generator (not shown) in unit 59 provides electrical energy through a conventional electrical wire 67 to drum 37 (FIG. 2). On drum 37, a slip ring or collector (not shown) of a conventional nature transmits the electrical signals and current between the wireline 35 and electrical wire 67 that lead to instruments located in cab 61.

In operation, unit 59 will be positioned on catwalk 13. A rig winch (not shown) will lift the assembly 25 onto rig floor 11. Normally, the wireline 35 will already be fed through the pack-off 33, grease injector 31 and quick connection 29. The downhole wireline tools are connected to the end of wireline 35, and the elevators 23 are placed about lifting sub 51. Blocks 19 are moved upward to lift the assembly 25 above the top of drill string 17. The wireline assembly 25 is particularly useful in conducting drill stem tests of a type described in U.S. Pat. No. 4,083,401, issued Apr. 11, 1978, all of which material is incorporated by reference. A surface test tree 69 will be coupled to drill string 17, forming the top of drill string 17. Drill string 17 will be supported by the subsea blowout preventers. The wireline tool is lowered into test tree 69 and the quick connection 29 is coupled to the top of test tree 69. Once connected, the subsea blowout preventers are released, and the blocks 19 will be raised to lift assembly 25, which in turn lifts the entire drill string 17 and supports it during the test operation. After the subsea test tree has been opened, the wireline tool can be lowered to the bottom of the drill string for the testing operation. The drum 37 and wireline instrument will be controlled from cab 61.

During the testing operation, if the drill string 17 has to be moved translationally up and down, the drum 37 will move with the drill string 17, maintaining the same amount of tension on wireline 35. Also, any movement of rig floor 11 due to wave action will not effect any tension in the wireline 35. Any movement of the drill string that is not accommodated by the heave compensator of blocks 19 would cause the entire drill string 17 to move, and along with it the wireline drum 37. After the test is completed, the wireline is retrived to the surface. Pressure in the drill string 17 during the test and during retrieval will be handled by the grease injector 31. When the wireline tool is at the surface, the subsea blowout preventer and test tree are closed. The assembly 25 is then uncoupled from surface test tree 69 and moved away from the rig floor 11.

The invention has significant advantages. By coupling a power driven wireline drum to the top of the well conduit, the tension will remain the same in the wireline despite any movement of the rig floor with respect to the drill string or vice versa. The rig up is simplified and more convenient since a wireline does not have to be drawn across part of the rig to a remote drum. The assembly does not interfere with the blocks, since the assembly is a load bearing structure that supports the drill string with the elevators. The length of the assembly does not need to be shorter than the distance between the elevators and the blocks, since the elevators will not be coupled to the drill string.

While the invention has been shown in only one of its forms, it should be apparent to those skilled in the art that it is not so limited but is susceptible to various changes and modifications without departing from the spirit of the invention.

I claim:

1. In an apparatus for running wireline tools in well conduit with a power driven drum, the improvement comprising:

a tubular member having mounting means for securing to the top of the well conduit and having a passage extending therethrough for the passage of wireline;

a sheave mounted adjacent the top of the tubular member for guiding wireline into the passage;

frame means for mounting the drum on a side of the tubular member with its axis perpendicular to the axis of the well conduit and below the sheave for reeving the wireline from the drum through the sheave; and a cylindrical lift sub secured to the frame means and having a collar means for engagement by a set of elevators to lift the well conduit with drilling rig blocks by using the tubular member, frame means and lift sub as a link between the blocks and the well conduit.

2. An apparatus for running wireline tools in a well conduit, comprising in combination:

a tubular member having a passage therethrough for receiving the wireline and a lower end for securing to the top of well conduit;

a sheave mounted adjacent the top of the tubular member for guiding the wireline; and frame means for mounting a drum on a side of the tubular member for support by the tubular member, the wireline being wound around the drum and reeved through the sheave;

a hydraulic motor mounted to the frame means and connected to the drum for rotating the drum; and hydraulic power means located in a remote unit for supplying pressurized hydraulic fluid through a hose to the hydraulic motor.

3. The apparatus according to claim 2 wherein the tubular member contains wireline sealing means for sealing the wireline while the wireline is moving.

4. The apparatus according to claim 2 further comprising a cylindrical lift sub mounted above the top of the tubular member and having a collar for engagement by elevators.

5. An apparatus for running a wireline tool in well conduit, comprising in combination:

a frame;

a drum wound with wireline and rotatably mounted to the frame with its axis of rotation perpendicular to the axis of the well conduit;

a hydraulic motor mounted to the frame and connected to the drum for rotating the drum;

hydraulic power means located in a remote unit for supplying pressurized hydraulic fluid through a hose to the hydraulic motor;

a tubular member mounted to the frame and having a lower end for connection to the well conduit;

a sheave carried by the frame adjacent the top of the tubular member, over which the wireline from the drum is reeved;

wireline sealing means carried by the tubular member of a type that utilizes pressurized viscous fluid to seal the wireline against pressure in a well conduit;

air pressure means remotely located for supplying pressure to the viscous fluid in the wireline sealing means;

wireline packoff means mounted to the tubular member for selectively forming a static seal about the wireline when the wireline is not moving; the wireline packoff means being actuated by hydraulic fluid pressure supplied from the hydraulic power means; and a cylindrical lift sub mounted to the frame above the top of the tubular member and having an annular collar for engagement by elevators of a drilling rig;

the frame, tubular member and lifting sub forming a load-bearing link between the elevators and the well conduit to allow the well conduit to be lifted with drilling rig blocks.

6. The apparatus according to claim 5 wherein the viscous fluid for the wireline sealing means is located in a reservoir mounted to the frame.

7. The apparatus according to claim 5 wherein the wireline is an insulated conductor cable, and wherein signals transmitted through the cable are transmitted through a wire to a unit located remote from the frame.

* * * * *